US007124907B2

(12) United States Patent
Conaway

(10) Patent No.: US 7,124,907 B2
(45) Date of Patent: Oct. 24, 2006

(54) SIPPY STRAW CUP

(75) Inventor: Jonathan W. Conaway, Hamilton, OH (US)

(73) Assignee: EvenFlo Company, Inc., Vandalia, OH (US)

( * ) Notice: Subject to any disclaimer, the term of this patent is extended or adjusted under 35 U.S.C. 154(b) by 63 days.

(21) Appl. No.: 10/726,059

(22) Filed: Dec. 2, 2003

(65) Prior Publication Data

US 2005/0115967 A1 Jun. 2, 2005

(51) Int. Cl.
*B65D 51/18* (2006.01)

(52) U.S. Cl. ..... 220/254.1; 220/705

(58) Field of Classification Search ..... 220/254.1, 220/705–710, 703; 215/387, 388, 229; 222/528–530

See application file for complete search history.

(56) References Cited

U.S. PATENT DOCUMENTS

D298,717 S 11/1988 Nichols et al.
5,150,815 A * 9/1992 Saklad ..... 220/708
5,203,468 A * 4/1993 Hsu ..... 220/254.3
5,259,538 A * 11/1993 Tardif ..... 222/528
5,273,172 A * 12/1993 Rossbach et al. ..... 215/229
5,339,982 A * 8/1994 Tardie ..... 220/708
5,361,934 A 11/1994 Spence, Jr.
D363,414 S * 10/1995 Goto et al. ..... D7/533
D364,314 S 11/1995 Humphrey et al.
D364,315 S 11/1995 Humphrey et al.
D364,316 S 11/1995 Humphrey et al.
D364,317 S 11/1995 Humphrey et al.
5,488,451 A 1/1996 Goggins
5,494,445 A 2/1996 Sekiguchi et al.
5,518,142 A 5/1996 Lin
5,520,304 A 5/1996 Lin
5,542,670 A 8/1996 Morano
5,579,948 A 12/1996 Lin
5,582,320 A 12/1996 Lin
5,617,178 A 4/1997 Goggins
5,695,346 A 12/1997 Sekiguchi et al.
D397,906 S 9/1998 Briggs et al.
D408,220 S 4/1999 Chomik
5,890,621 A 4/1999 Bachman et al.
5,896,230 A 4/1999 Goggins
5,897,013 A * 4/1999 Manganiello ..... 220/252
D412,085 S 7/1999 Roush et al.
D419,029 S 1/2000 Randolph
6,050,433 A * 4/2000 Russell et al. ..... 215/229
6,050,445 A 4/2000 Manganiello (Continued)

OTHER PUBLICATIONS

Lenticular Corporation; Products, web page; www.lenticular.com, Lenticular Corporation, Oregon, WI.

*Primary Examiner*—Lien M. Ngo
(74) *Attorney, Agent, or Firm*—Taft, Stettinius & Hollister, LLP

(57) ABSTRACT

A closure for a container adapted to house a beverage therein, the closure comprising: (a) a cap having a mating feature adapted to interface with a corresponding feature of a container to secure the cap thereto, the cap also including an orifice therethrough and a channel therewithin, the channel being adapted to receive a sliding member therein; and (b) a flexible conduit adapted to be in fluid communication with a beverage within the container, wherein the sliding member is operative to position the flexible conduit between an open position and a closed position, where the open position enables fluid communication between a drinking end and an interior of the container.

20 Claims, 8 Drawing Sheets

U.S. PATENT DOCUMENTS

| | | | | |
|---|---|---|---|---|
| D431,159 | S | * | 9/2000 | Otake ..... D7/510 |
| D434,272 | S | | 11/2000 | Johansen et al. |
| D434,273 | S | | 11/2000 | Johansen et al. |
| RE37,016 | E | | 1/2001 | Morano |
| D440,465 | S | | 4/2001 | La Torre et al. |
| 6,251,566 | B1 | | 6/2001 | Brosh et al. |
| D448,242 | S | | 9/2001 | McDonough et al. |
| D448,976 | S | | 10/2001 | McDonough et al. |
| D457,384 | S | | 5/2002 | Randolph |
| D457,778 | S | | 5/2002 | Randolph et al. |
| 6,422,415 | B1 | | 7/2002 | Manganiello |
| 6,424,467 | B1 | | 7/2002 | Goggins |
| D463,216 | S | | 9/2002 | McDonough et al. |
| 6,490,092 | B1 | | 12/2002 | Goggins |
| 6,523,711 | B1 | * | 2/2003 | Hughes et al. ..... 220/709 |
| 6,718,664 | B1 | * | 4/2004 | Williams ..... 40/324 |
| 2003/0016370 | A1 | | 1/2003 | Goggins |

* cited by examiner

SIPPY STRAW CUP

BACKGROUND

1. Field of the Invention

The present invention is directed to a child cup, commonly known as a "sippy cup," comprising a cup coupled to a lid having an opening therethrough adapted to received a straw. More specifically, the invention is directed to a sippy cup having a sliding actuator positioning a straw coupled to a lid between an erect position accessible by a child and a closed position where the actuator covers over the straw making inaccessible an open end of the straw for drawing fluid from the sippy cup.

2. Background of the Invention

Specialty child cups have been in the marketplace for a number of years. These child cups limit the availability of a fluid, typically a beverage, from entirely spilling from the cup once the cup has been overturned by the child. Prior art cups have included generally two pieces; a cup and a top lid having an opening therethrough.

The opening through these prior art lids was designed to limit the cross sectional area through which the fluid may travel, thereby keeping the amount of unintended fluid exiting the cup to a minimum when the cup is overturned. These lids have generally included a molded nipple or other similarly shaped protrusion adapted to be received by the child's mouth to create a fluidic seal between the lid and child's mouth. An example might include U.S. Pat. No. 6,568,557.

SUMMARY OF THE INVENTION

The present invention is directed to a child cup, commonly known as a "sippy cup," comprising a cup coupled to a lid having an opening therethrough adapted to received a straw. The straw provides a means for directing a fluid contained within the cup to a child's mouth by the child depressurizing a portion of the straw and drawing the fluid through the straw. More specifically, the present invention is directed to a sippy cup having a sliding actuator positioning a straw between an erect position accessible by a child and a closed position making inaccessible an open end of the straw for drawing fluid from the sippy cup.

In an exemplary embodiment, the sippy straw cup includes a cup adapted to be coupled to a lid to create a fluidic seal therebetween. The cup includes an inner wall and an outer wall being separated by a space therebetween. The space may be occupied in part by a lenticular image providing a means of entertainment for the child. The lid includes a convex exterior and a concave interior, where the concave interior includes a conduit continuing through to the convex exterior/top. The convex exterior includes an arcuate, oblong channel receiving a sliding actuator therein. The sliding actuator is positionable between an open position where a straw riding within the conduit of the lid is in an erect position and a closed position where the straw is rendered inaccessible by the sliding actuator covering the straw and wedging the straw between the underside of the actuator and the recessed top surface of the lid. In the closed position, fluid within the cup is unable to be withdrawn through the straw.

It is a first aspect of the present invention to provide a closure for a container adapted to house a beverage therein, the closure comprising: (a) a cap having a mating feature adapted to interface with a corresponding feature of a container to secure the cap thereto, the cap also including an orifice therethrough and a channel therewithin, the channel being adapted to receive a sliding member therein; and (b) a flexible conduit adapted to be in fluid communication with a beverage within the container, wherein the sliding member is operative to position the flexible conduit between an open position and a closed position, where the open position enables fluid communication between a drinking end and an interior of the container.

In a more detailed embodiment of the first aspect, the flexible conduit biases the sliding member in the open position. In another more detailed embodiment, the sliding member includes a trench adapted to receive at least a portion of the flexible conduit when the flexible conduit is between the open position and the closed position. In yet another more detailed embodiment, the flexible conduit includes molded retention features thereon to inhibit the flexible conduit from being pulled through the orifice. In a further detailed embodiment, the trench runs parallel to the channel and parallel to a range of movement available to the sliding member. In still a further more detailed embodiment, the cap includes a trench adapted to receive at least a portion of the flexible conduit when in the closed position, wherein the trench includes a dam operative to discontinue fluid communication with the beverage in the closed position. In yet a further more detailed embodiment, the sliding member is substantially radially recessed within the channel. In another detailed embodiment, the sliding member includes at least one fin received within at least one guide groove formed within a side wall of the channel. In yet another more detailed embodiment, the flexible conduit is adapted to receive a rigid conduit for extending approximate a bottom of the container. In still a further more detailed embodiment, a bottom of the cap is substantially concave.

In a more detailed embodiment of the first aspect, the cap is substantially dome shaped. In a further detailed embodiment, the container includes a lenticular image. In yet a further detailed embodiment, the container includes concentric gripping rings. In a more detailed embodiment, the sliding member slides radially. In another more detailed embodiment, the container includes a holographic image. In yet another detailed embodiment, the cap includes circumferentially arranged gripping aids.

It is a second aspect of the present invention to provide a container comprising:

(a) a cup adapted to hold a beverage therein, the cup having a lenticular image associated therewith; and (b) a cap having a mating feature adapted to interface with a corresponding feature of the cup to secure the cap thereto, the cap also including an orifice therethrough coupled to a flexible conduit adapted to be in fluid communication with the beverage within the cup, wherein at least one of a pivoting member and a sliding member coupled to the cap is operative to position the flexible conduit between an open position and a closed position, where the open position enables fluid communication between a drinking end of the flexible conduit and an interior of the cup.

In a more detailed embodiment of the second aspect, the lenticular image is interposed between a clear outer cup and to an inner cup. In another more detailed embodiment, the clear outer cup and the inner cup are coupled together by spin molding. In yet another more detailed embodiment, the cap includes an arched channel therewithin, the arched channel being adapted to receive a sliding member therein, wherein the sliding member is operative to position the flexible conduit to protrude from an outer surface in the open position and recess the flexible conduit within the outer circumferential surface in the closed position.

DETAILED DESCRIPTION

The exemplary embodiments of the present invention are described and illustrated below as a fluid container, referred to below as a "sippy straw cup", comprising a cup and corresponding lid having a sliding actuator to regulate fluid communication between an interior of the sippy straw cup and an external environment. The various orientational, positional, and reference terms used to describe the elements of the present invention are therefore used according to this frame of reference. However, for clarity and precision, only a single orientational or positional reference will be utilized; and, therefore it will be understood that the positional and orientational terms used to describe the elements of the exemplary embodiment of the present invention are only used to describe the elements in relation to one another.

Figure 1:
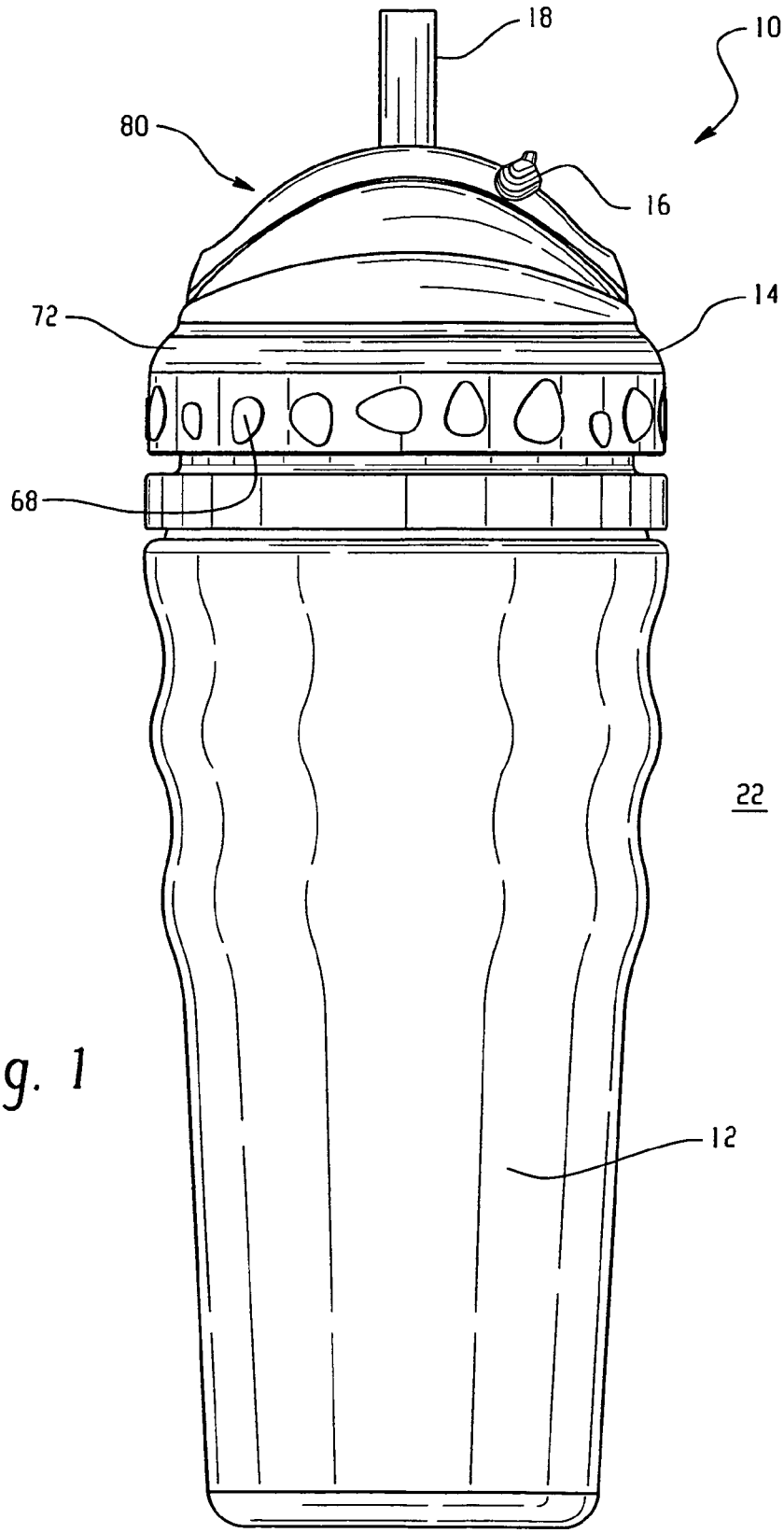
FIG. 1 is a side view of an exemplary embodiment of the present invention.
Figure 2:
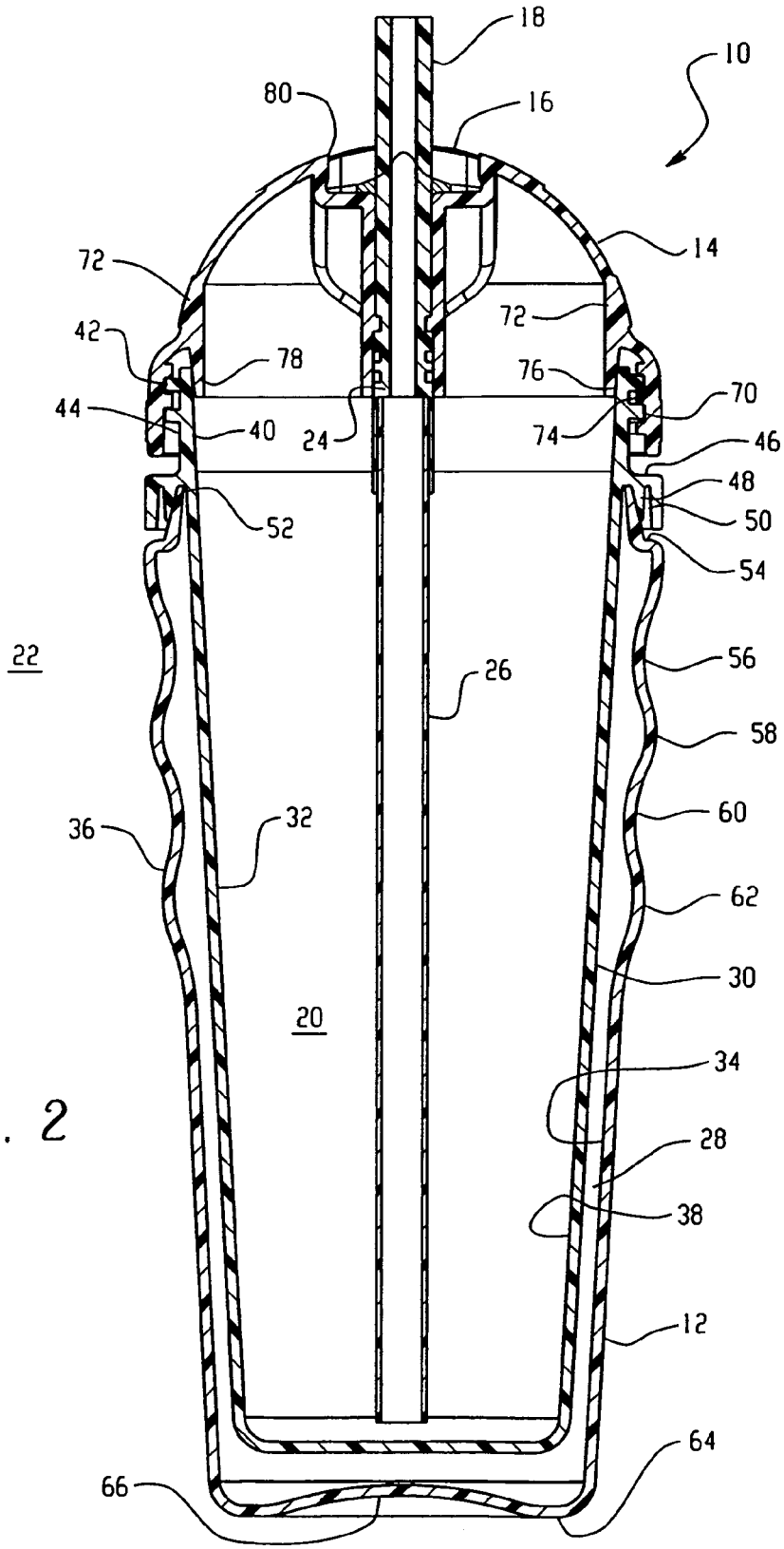
FIG. 2 is a cross-sectional view the exemplary embodiment of the present invention taken along lines 1—1 of FIG. 1.

Referring to FIGS. 1 and 2, an exemplary embodiment of a sippy straw cup 10 includes a cup 12, a lid 14, a sliding actuator 16, and a straw 18 providing a selectively sealed fluid reservoir 20 available for holding a fluid therein, that may include, without limitation, a beverage. In an open position, as shown, the straw 18 is erect and provides fluid communication between the fluid reservoir 20 and an external environment 22. The straw 18 may include two or more sections, with a first section 24 being resilient and a second section 26 coupled to the first section 24 that is less resilient and not readily amendable to spatial deformation.

Figure 4:
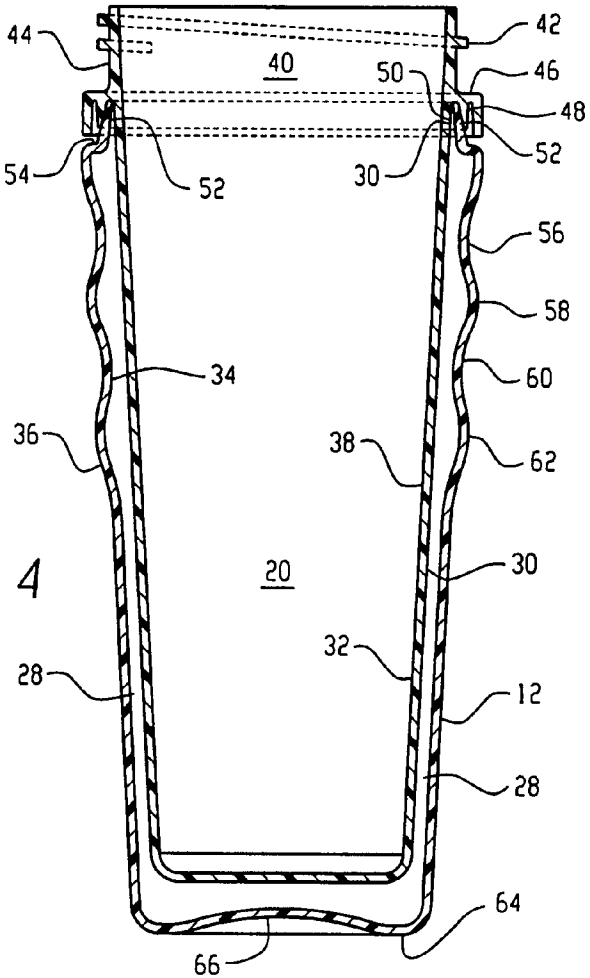
FIG. 4 is a cross-sectional view the exemplary cup component in accordance with the exemplary embodiment of the present invention taken along lines 3—3 of FIG. 3.
Figure 3:
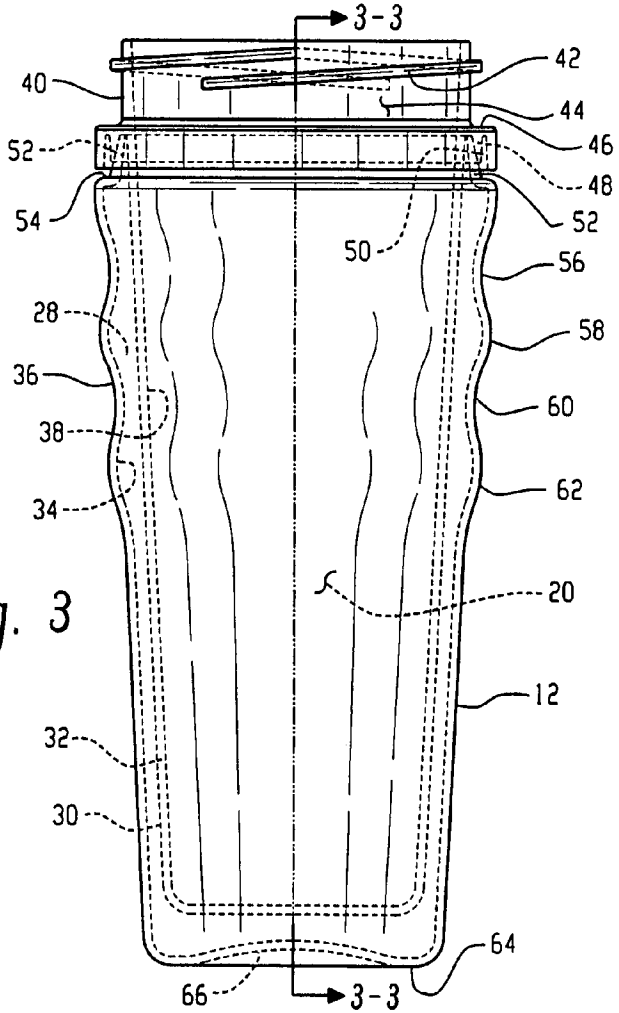
FIG. 3 is a side view of an exemplary cup component in accordance with the exemplary embodiment of the present invention.
Figure 5:
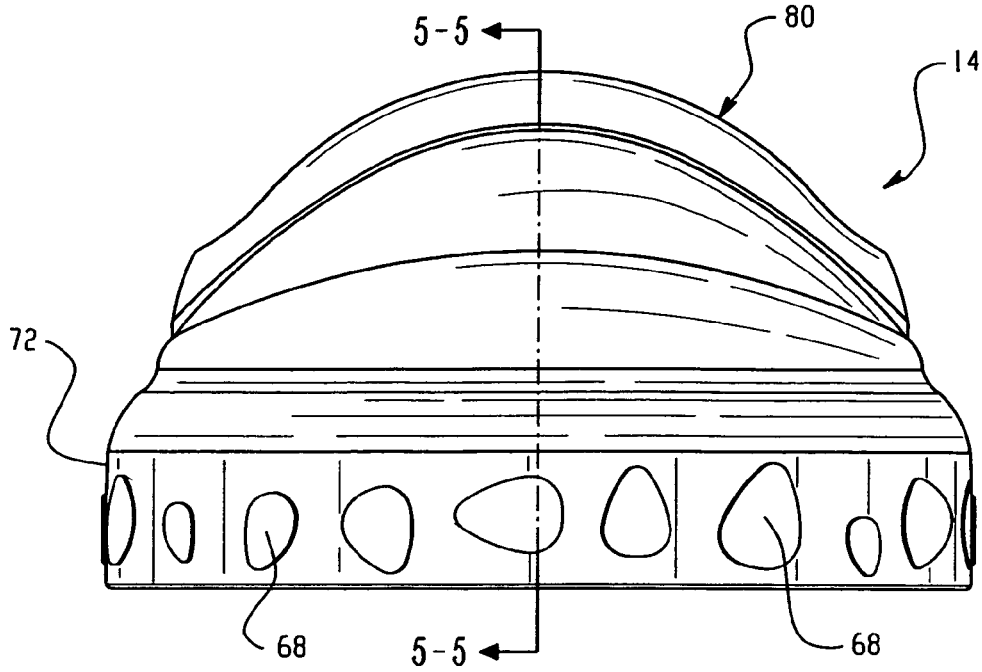
FIG. 5 is a side view of an exemplary lid component in accordance with the exemplary embodiment of the present invention.
Figure 6:
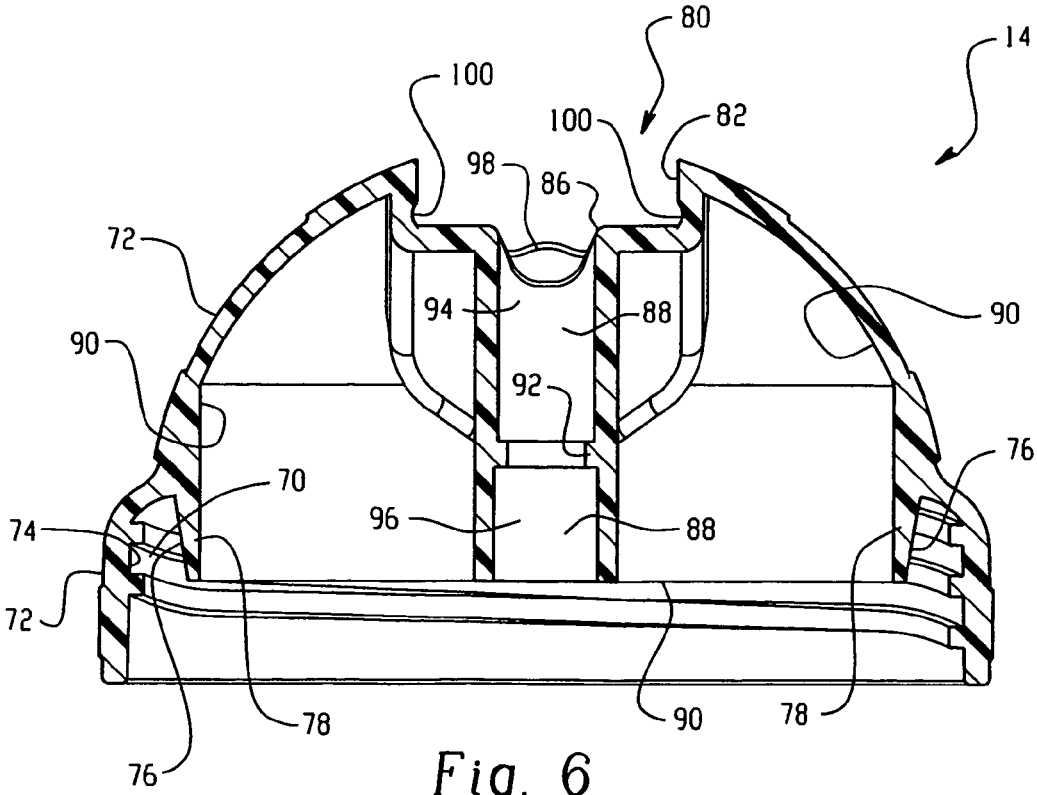
FIG. 6 is a cross-sectional view the exemplary lid component in accordance with the exemplary embodiment of the present invention taken along lines 5—5 of FIG. 5.
Figure 7:
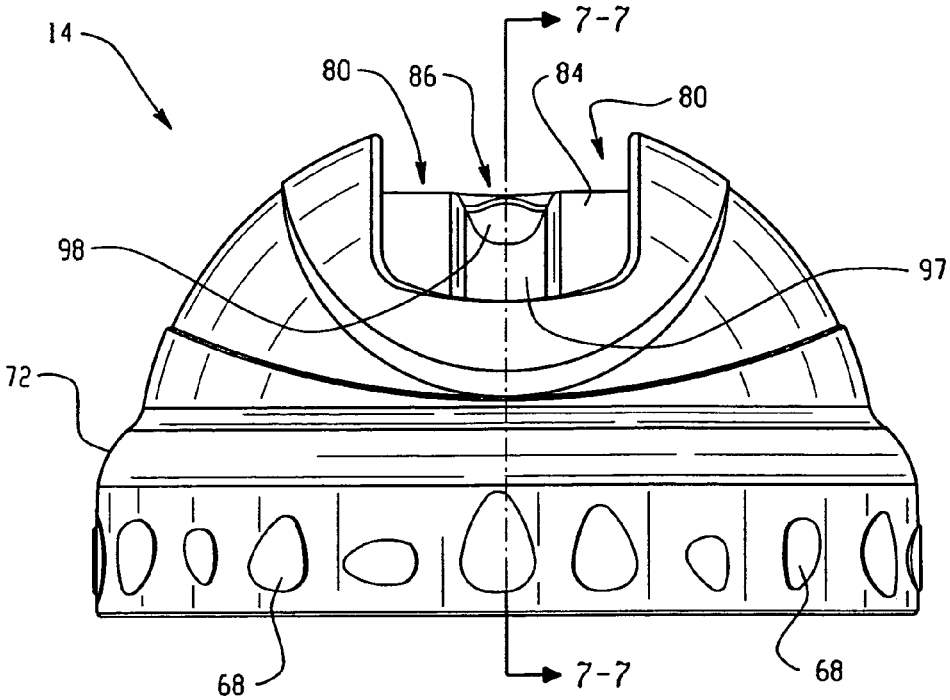
FIG. 7 is a frontal view of an exemplary lid component in accordance with the exemplary embodiment of the present invention.
Figure 8:
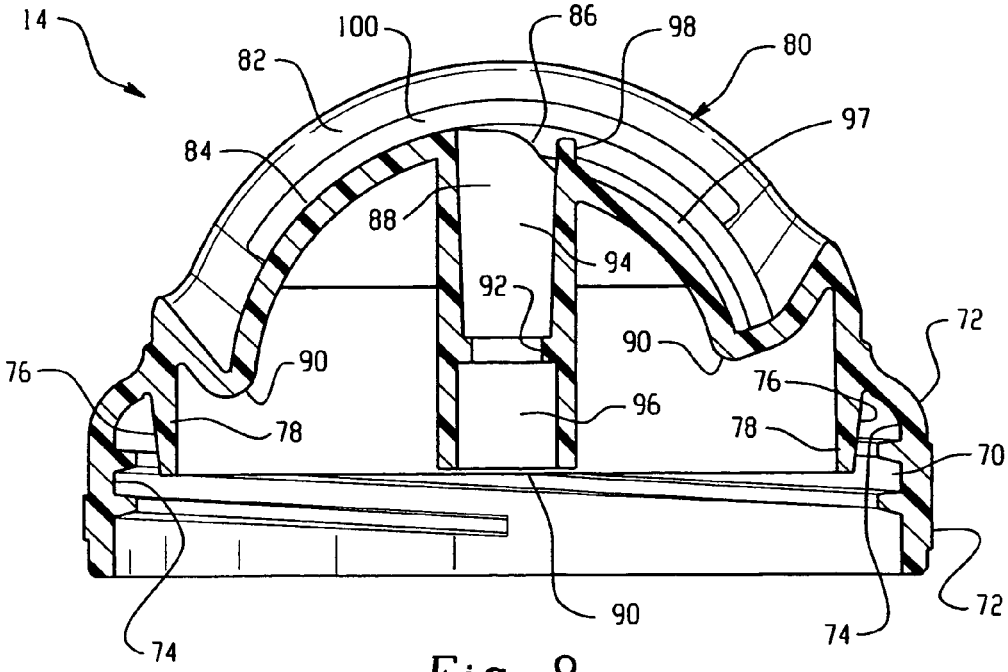
FIG. 8 is a cross-sectional view the exemplary lid component in accordance with the exemplary embodiment of the present invention taken along lines 7—7 of FIG. 7.

Referencing FIGS. 2–4, the cup 12 includes a cavity 28 partially defined by an exterior wall 30 of an inner cup 32 and partially by an interior wall 34 of an outer cup 36. The cavity 28 may be adapted to receive a graphical expression (not shown), in which case the outer cup may be transparent to facilitate visual appeal. The graphical expression may include a lenticular or holographic image on a medium positioned within the cavity 28. Those of ordinary skill in the art are familiar with the methods of forming lenticular, holographic, or other images onto various mediums.

The inner cup 32 includes an interior wall surface 38 defining the reservoir 20 and a spout 40 having spiral protrusions 42 on an exterior surface 44 adapted to be received within corresponding grooves 70 within the lid 14 for securing the lid 14 to the cup 12. The spout 40 includes a ledge 46 transitioning into a circumferential wall 48 forming a recess 50 between the circumferential wall 48 and the exterior wall 30 of the inner cup 32. The recess 50 is adapted to receive a top portion 52 of the outer cup 36, where the outer cup 36 and the inner cup 32 may be coupled together by spin sealing.

The outer cup 36 transitions from the top portion 52 into a sill 54 circumferentially thereabout that tapers inward to create a first indentation 56. The first indentation 56 leads into a first mound 58 that gives rise to a second indentation 60 and thereafter a second mound 62. Each indentation 56, 60 and each mound 58, 62 is circumferentially distributed about the outer cup 36. The second mound 62 transitions into a smooth taper terminating at a bottom aspect 64 having a dome shaped underneath surface 66.

Figure 12:
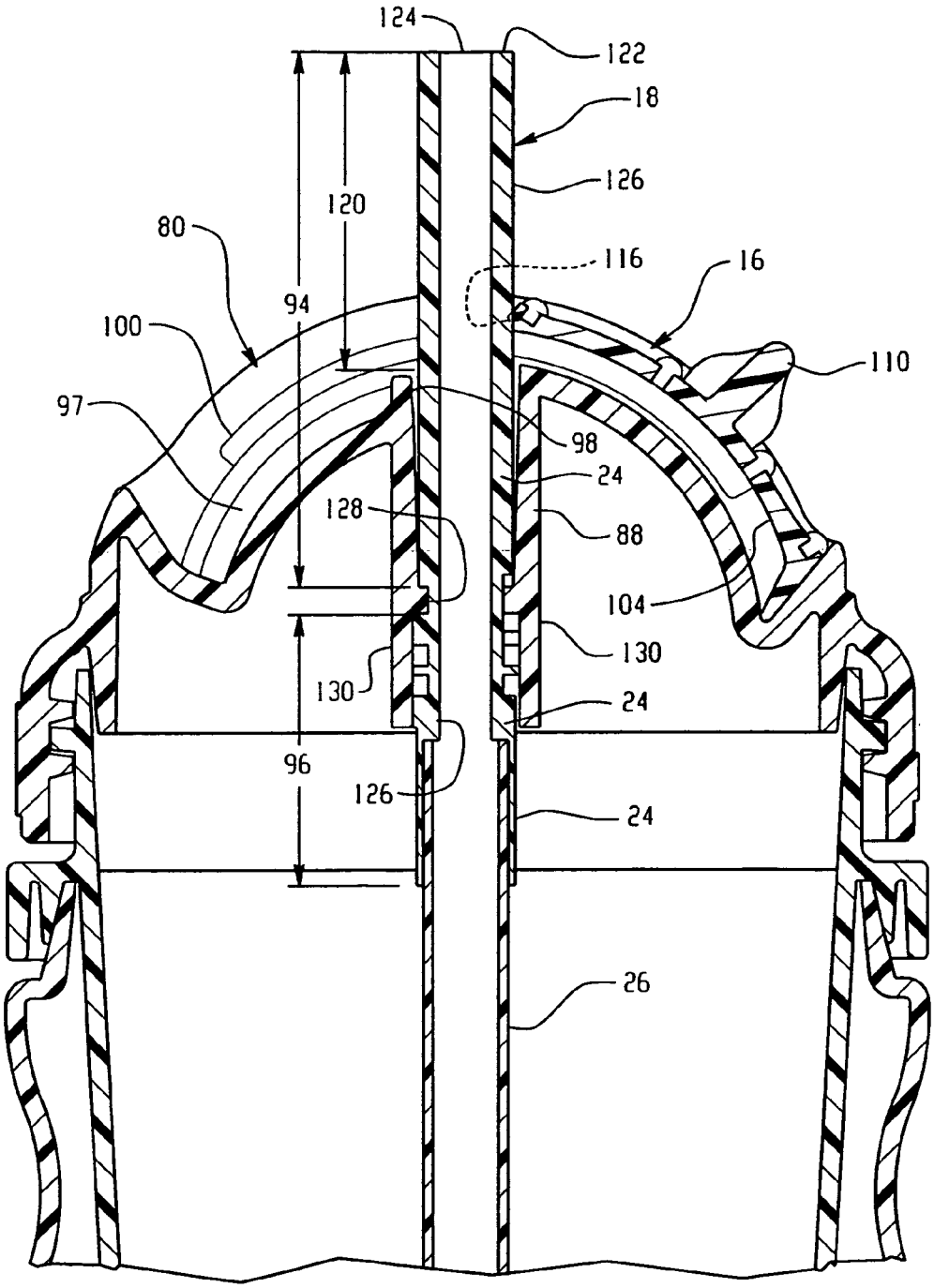
FIG. 12 is a cross-sectional view, from the side, of the exemplary lid and sliding actuator components in accordance with the exemplary embodiment of the present invention providing fluid communication between the fluid within the container and an external environment.

Referencing FIGS. 5–8, the lid 14 is substantially domed shaped having a plurality of raised areas 68 circumferentially distributed thereabout to facilitate gripping as the corresponding grooves 70 within an outer wall 72 receive the spiral protrusions 42 of the inner cup 32 to couple the lid 14 to the cup 12 (See FIG. 12). A fluidic seal is created between an interior surface 74 of the outer wall 72 and the exterior surface 42 of the inner cup 32, as well as between an interior surface 76 of an inner lip 78 (extending from the outer wall 72) and the interior surface 38 of the inner cup 32. The outer wall 72 transitions upward from the inner lip 78 in an arcuate manner until terminating at a recess 80.

Figure 9:
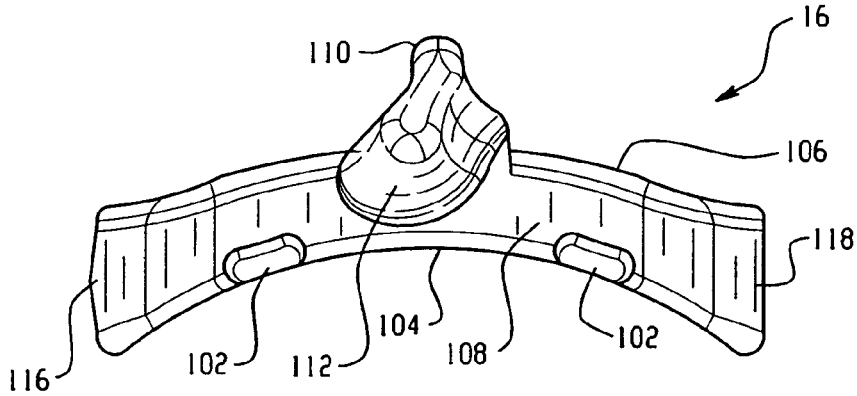
FIG. 9 is a side view of an exemplary sliding actuator component in accordance with the exemplary embodiment of the present invention.
Figure 10:
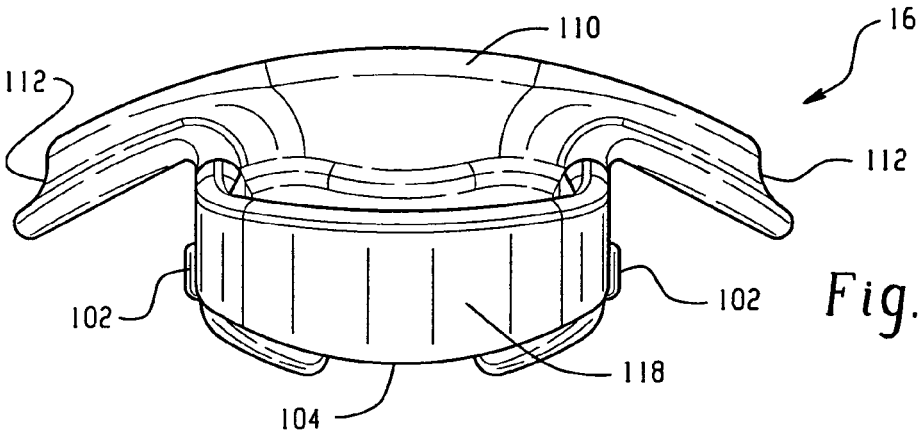
FIG. 10 is a rearward view of the exemplary sliding actuator component in accordance with the exemplary embodiment of the present invention.
Figure 11:
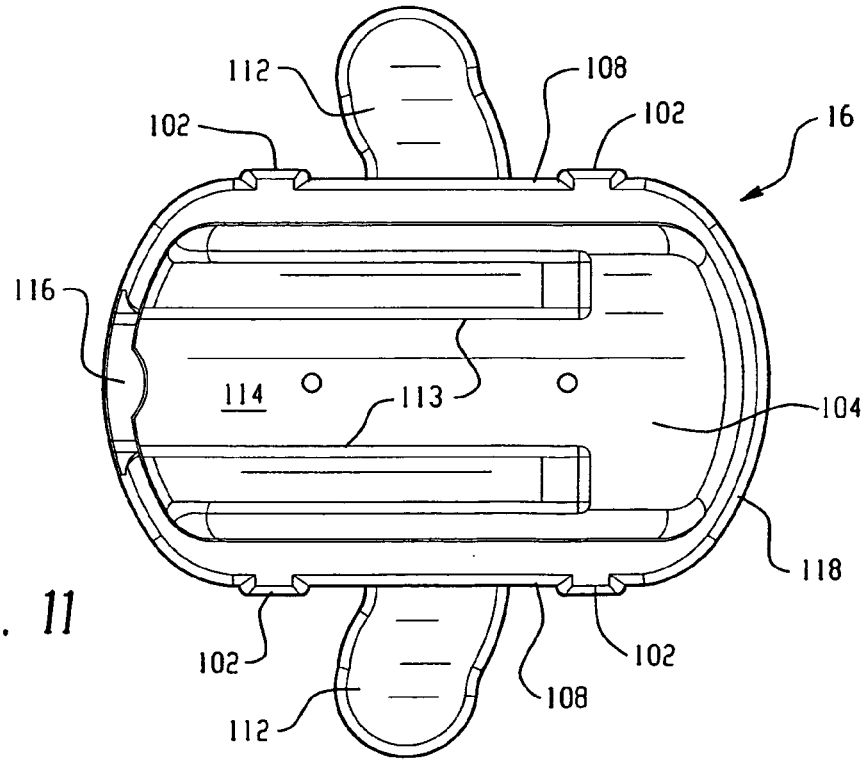
FIG. 11 is a bottom view of the exemplary sliding actuator component in accordance with the exemplary embodiment of the present invention.

The recess 80 includes a side surface 82 being essentially square with an arcuate top surface 84. The arcuate top surface 84 defines an orifice 86 therein and gives rise to a conduit 88 extending from the top arcuate surface 84 of the recess 80 to an underneath surface 90 of the lid 14. The conduit 88 includes circumferential projection 92 separating a first cylindrical portion 94 and a second cylindrical portion 96 having a greater diameter than the first cylindrical portion 94. A groove 97, adapted to receive the straw 18, is formed within the recess 80 and includes a finger 98 abutting the orifice 86. The side surface 82 of the recess 80 includes a guide notch 100 cut therein following the generally arcuate shape of the recess that is adapted to receive guide pins 102 of the sliding actuator 16 (See FIGS. 9–11).

Referring to FIGS. 9–12, the sliding actuator 16 is adapted to be received within the recess 80 and includes a generally arcuate shape from the side, where an underneath surface 104 is adapted to ride along the top surface 84 of the recess 80 and a top surface 106 of the actuator 98 is adapted to be substantially flush with the outer wall 72 of the lid 14 upon being seated within the recess 80. Two guide pins 102 protrude from each side 108 of the actuator 16 and are operative to guide the actuator 16 within the recess 80 from a closed position where the straw 18 is wedged between the underneath surface 104 and the top surface 84 and an open position where the straw 18 is erect.

A contoured ridge 110 extends across the actuator 16 and includes two sliding guides 112 adapted to slide along the outer wall 72. The contoured ridge 110 provides an actuation point for a user to push against or pull on the ridge 110 to effect motion of the actuator 16 with respect to the recess 80. The underneath surface 104 includes a pair of rectangular projections 113 forming a mating channel 114 therebetween. The front 116 of the actuator 16 is partially open to guide the cylindrical nature of the straw 18 into the mating channel 114 when the actuator 16 is in the closed position. The straw 18 may include exterior features such as guide grooves or ridges (not shown) to further facilitate alignment within the groove 97 and the mating channel 114.

Referencing FIG. 12, the open position of the sippy straw cup 10 is shown having the first section 24 of the straw 18 partially received within the conduit 88 and includes an exposed section 120 with a tip 122 at the end not received within the conduit 88. An orifice 124 defined by a wall 126 of the straw 18 provides a generally constant internal diameter providing a circular cross-sectional area available for fluid flow therethrough. This generally constant internal diameter continues for the length of the first cylindrical portion 94 and part of the second cylindrical portion 96. The radius of orifice 124 and the radius of the wall 126 aggregate to approximate the internal diameter of the conduit 88. The straw 18 includes an indentation 128 that receives the circumferential projection 92 seating the straw 18 within the conduit 88. The wall 126 increases in thickness to abut an interior wall 130 of the second cylindrical portion 96, and when teamed with the indentation 128 and the circumferential projection 92, inhibits vertical movement of the straw 18 within the conduit 88. Just beyond the exit of the conduit 88, a step change within the straw is present where the orifice 124 increases in cross-section to receive the second section 26 adapted be in direct contact with the beverage occupying the reservoir 20 of the sippy straw cup 10.

Figure 13:
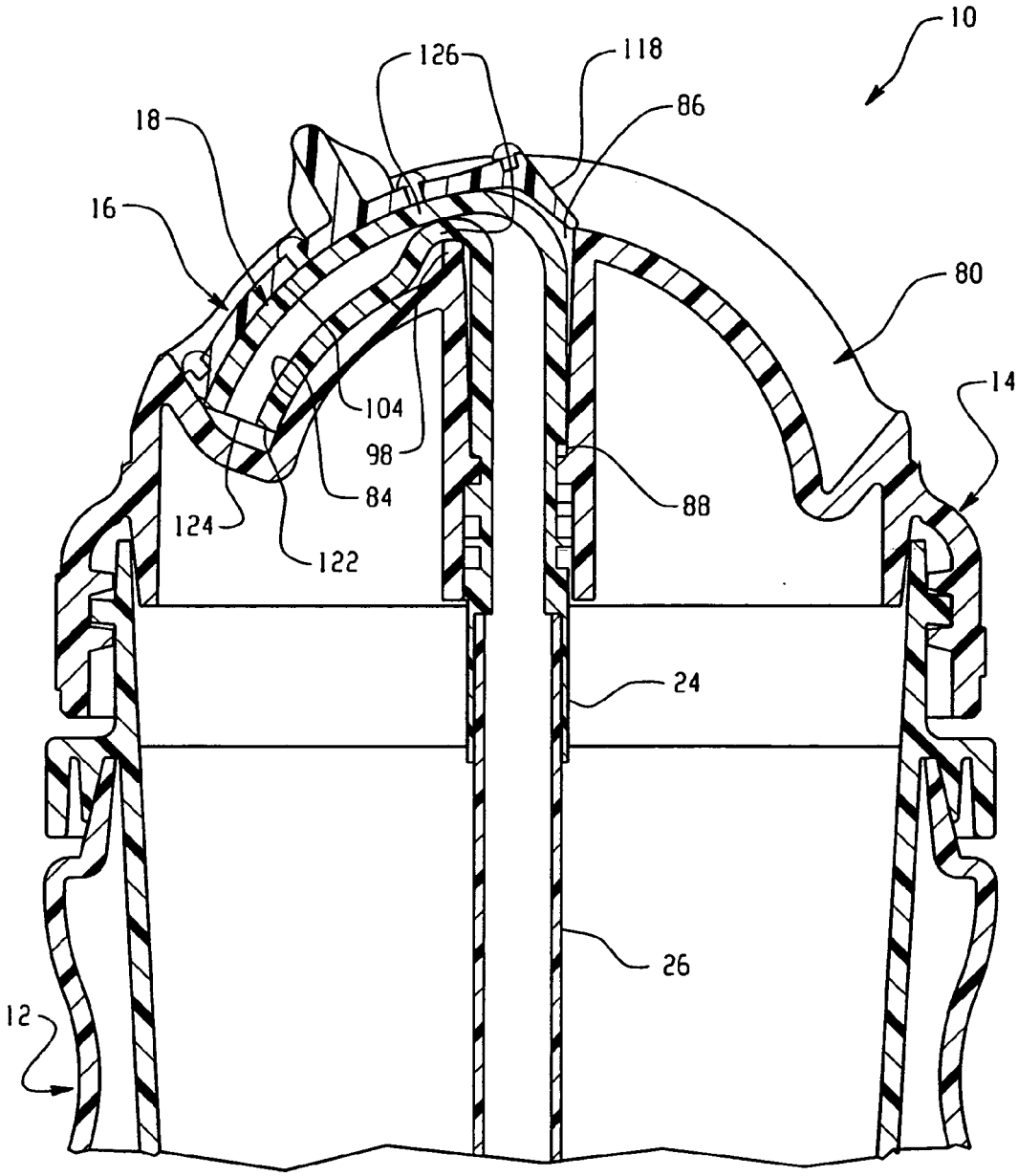
FIG. 13 is a cross-sectional view, from the side, of the exemplary lid and sliding actuator components in accordance with the exemplary embodiment of the present invention inhibiting fluid communication between the fluid within the container and an external environment.

Referring to FIG. 13, the closed position of the sippy straw cup 10 is shown having the straw 14 wedged between the underneath surface 104 of the actuator 16 and the top surface 84 of the recess 80. In practice, as the actuator 16 is repositioned from the open position to the closed position, the front 116 of the actuator 16 contacts the external wall 126 of the exposed section 120 of the straw 18 and pushes the straw forward. The open section of the front 116 of the actuator 16 and the mating channel 114 receives the exposed section 120 of the straw 18 as the actuator 16 continues moving forward, thereby pushing the straw 18 over the finger 98 projecting outward from the conduit 88 and into the groove 97 formed within the recess 80. As the straw 18 is received within the groove 97 and mating channel 114, the finger 98 forces one side of the straw wall 126 against the other side of the straw wall 126, discontinuing the orifice 124 within the straw 18 to inhibit fluid communication between the second section 26 and the tip 122 of the straw 18. The forward movement of the actuator 16 pushes the straw 18 completely within the groove 97 and mating channel 114 while the rear section 118 of the actuator 16 covers the orifice 86. When moving from the closed to the open position, the actuator 16 is moved backward, gradually uncovering the exposed section 120 of the straw 18 previously seated within the groove 97 and mating channel 114 such that the resiliency of first section 26 of the straw 18 gradually raises the straw 18 to an erect position abutting the front 116 of the actuator 16.

Following from the above description and invention summaries, it should be apparent to those of ordinary skill in the art that, while the methods and apparatuses herein described constitute exemplary embodiments of the present invention, the inventions contained herein are not limited to these precise embodiments and that changes may be made to them without departing from the scope of the invention as defined by the claims. Additionally, it is to be understood that the invention is defined by the claims and it is not intended that any limitations or elements describing the exemplary embodiments set forth herein are to be incorporated into the meanings of the claims unless such limitations or elements are explicitly recited in the claims. Likewise, it is to be understood that it is not necessary to meet any or all of the identified advantages or objects of the invention disclosed herein in order to fall within the scope of any claim, since the invention is defined by the claims and since inherent and/or unforeseen advantages of the present invention may exist even though they may not have been explicitly discussed herein.

What is claimed is:

1. A closure for a container adapted to house a beverage therein, the closure comprising:

a cap having a mating feature for interfacing with a corresponding feature of a container to secure the cap thereto, the cap also including an orifice therethrough and a channel therewithin, the channel receiving a sliding member therein; and a flexible conduit for establishing fluid communication with a beverage within the container, wherein the sliding member is operative to position the flexible conduit between an open position and a closed position, where the open position enables fluid communication between a drinking end and an interior of the container, and where at least a portion of the flexible conduit is located within the channel in the closed position;

wherein a first portion of the channel is uncovered when the flexible conduit is in the closed position and a second portion of the channel is occupied by the sliding member when the flexible conduit is in the closed position; and wherein the first portion of the channel is occupied by the sliding member when the flexible conduit is in the open position and the second portion of the channel is uncovered when the flexible conduit is in the open position.

2. The container closure of claim 1, wherein the flexible conduit biases the sliding member in the open position.

3. The container closure of claim 1, wherein the sliding member includes a trench adapted to receive at least a portion of the flexible conduit when the flexible conduit is between the open position and the closed position.

4. The container closure of claim 1, wherein the flexible conduit includes molded retention features thereon to inhibit the flexible conduit from being pulled through the orifice.

5. The container closure of claim 1, wherein the cap includes a trench adapted to receive at least a portion of the flexible conduit when in the closed position, wherein the trench includes a dam operative to discontinue fluid communication with the beverage in the closed position.

6. The container closure of claim 5, wherein the trench runs parallel to the channel and parallel to a range of movement available to the sliding member.

7. The container closure of claim 1, wherein the sliding member is substantially radially recessed within the channel.

8. The container closure of claim 1, wherein the sliding member includes at least one fin received within at least one guide groove formed within a side wall of the channel.

9. The container closure of claim 1, wherein the flexible conduit is adapted to receive a rigid conduit for extending approximate a bottom of the container.

10. The container closure of claim 1, wherein a bottom of the cap is substantially concave.

11. The container closure of claim 1, wherein the cap is substantially dome shaped.

12. The container closure of claim 1, wherein the container includes a lenticular image.

13. The container closure of claim 1, wherein the container includes concentric gripping rings.

14. The container closure of claim 1, wherein the sliding member slides radially.

15. The container closure of claim 1, wherein the container includes a holographic image.

16. The container closure of claim 1, wherein the cap includes circumferentially arranged gripping aids.

17. A container comprising:

a cup adapted to hold a beverage therein, the cup having a lenticular image associated therewith; and a cap having a mating feature adapted to interface with a corresponding feature of the cup to secure the cap thereto, the cap also including an orifice therethrough coupled to a flexible conduit adapted to be in fluid communication with the beverage within the cup, wherein at least one of a pivoting member and a sliding member coupled to the cap is operative to position the flexible conduit between an open position and a closed position, where the open position enables fluid communication between a drinking end of the flexible conduit and an interior of the cup, and where the cap includes a channel therein and at least a portion of the flexible conduit is located within the channel in the closed position;

wherein a first portion of the channel is uncovered when the flexible conduit is in the closed position and a second portion of the channel is occupied by at least one of the pivoting member and the sliding member when the flexible conduit is in the closed position; and wherein the first portion of the channel is occupied by at least one of the pivoting member and the sliding member when the flexible conduit is in the open position and the second portion of the channel is uncovered when the flexible conduit is in the open position.

18. The container of claim 17, wherein the lenticular image is interposed between a clear outer cup and to an inner cup.

19. The container of claim 18, wherein the clear outer cup and inner cup are coupled together by spin molding.

20. The container of claim 17, wherein the channel is arched, the arched channel being adapted to receive a sliding member therein, wherein the sliding member is operative to position the flexible conduit to protrude from an outer surface in the open position and recess the flexible conduit within an outer circumferential surface in the closed position.

* * * * *